United States Patent [19]

Koziol et al.

[11] Patent Number: 4,743,351

[45] Date of Patent: May 10, 1988

[54] COATED VALVE METAL ANODE FOR ELECTROLYTIC EXTRACTION OF METALS OR METAL OXIDES

[75] Inventors: Konrad Koziol, Röthenbach a.d. Pegnitz; Erich Wenk, Nüremberg, both of Fed. Rep. of Germany

[73] Assignee: Conradty GmbH & Co. Metallelektroden KG, Fed. Rep. of Germany

[21] Appl. No.: 703,547

[22] Filed: Feb. 20, 1985

[30] Foreign Application Priority Data

Feb. 24, 1984 [DE] Fed. Rep. of Germany ..... 3406823

[51] Int. Cl.[4] ..... C25B 1102; C25B 11/10; C25C 7/02; C25D 17/10

[52] U.S. Cl. ..... 204/280; 204/289; 204/290 F

[58] Field of Search ..... 204/286, 288, 289, 279, 204/284, 228, 280, 290 F

[56] References Cited

U.S. PATENT DOCUMENTS

| | | | |
|---|---|---|---|
| 1,935,395 | 11/1933 | Engle | 204/228 X |
| 4,401,530 | 8/1983 | Clere | 204/284 X |
| 4,469,580 | 9/1984 | Deborski et al. | 204/286 X |
| 4,482,448 | 11/1984 | Bowen et al. | 204/286 X |
| 4,488,946 | 12/1984 | Morris et al. | 204/286 X |

*Primary Examiner*—Donald R. Valentine
*Attorney, Agent, or Firm*—Lyon & Lyon

[57] ABSTRACT

A metal anode comprises a current feed and at least one current distributor branching therefrom. The current distributor has a sleeve consisting of two identically formed profiled members which each have a respective crosspiece and two unequal limbs extending from its ends at right angles in opposite senses. The two profiled members are, for formation of the sleeve, assembled together so that the shorter limb of the one profile member lies in the region of the free end of the longer limb of the other profile member, whereby on the two narrow sides of the sleeve offset projecting flanges result. On these flanges are connected respective plate-like elements. These form the active part of the electrode. The plate-like elements consist expediently of corrugated expanded metal.

12 Claims, 4 Drawing Sheets

COATED VALVE METAL ANODE FOR ELECTROLYTIC EXTRACTION OF METALS OR METAL OXIDES

The invention relates to an electrode, in particular an anode of coated valve metal for electrolytic extraction of metals or metal oxides, comprising:

at least one current distributor which is constructed from a valve metal sleeve assembled from two identical profile members and a core which is arranged therein, is of metal which is a good electrical conductor, and is in electrical connection with the sleeve; and an active part which is electrically and mechanically connected to the sleeve of the current distributor.

Coated metal anodes of this type are intended to replace the anodes of lead, lead alloys or graphite formerly used in the field of electrolytic extraction of metals, in particular non-ferrous metals, from acid solutions which contain the metal to be extracted. The working surface or the active part of these coated metal anodes consists of a core carrier of valve metal such as for example titanium, zirconium, niobium or tantalum, on which is applied a coating of an anodically effective material, for example of metals from the platinum group or the platinum metal oxides.

The main advantage of the metal anodes consists in the saving of electrical energy as compared with the usual lead or graphite anodes. This energy economy results from the larger outer surface which can be achieved with coated metal anodes, the high activity of the coating and the shape stability. It enables a considerable reduction of the anode voltage. The coated metal anodes result in a further operational economy in that cleaning and neutralization of the electrolyte is simplified since the anode coating is not destroyed by $Cl^-$, $NO_3^-$ or free $H_2SO_4$. An additional cost saving is achieved in that, with the use of coated metal anodes, the electrolyte need not be alloyed with expensive components such as cobalt compounds or strontium carbonate, such as is necessary in the use of lead anodes. Furthermore, contamination of the electrolyte and the extracted metal with lead, which cannot be avoided with lead anodes, is prevented. Finally, the coated metal anodes permit increase of the current density and thus of the productivity.

In the development of these coated metal anodes, widely differing routes have been followed.

With one known metal anode (DE-OS No. 24 04 167) the important construction criterion was seen in that the anode surface lying opposite the cathode should be 1.5 to 20 times smaller than the cathode outer surface and the anode would accordingly be operated with a current density which is 1.5 to 20 times larger than the cathode current density. As a result, in an economical manner a relatively clean metal extraction of the desired crystalline structure and purity is alleged to be obtained on the cathodes. It is apparently maintained that the economy consists in that as a result of the reduced surface of the anode opposite the cathode the material consumption for the production of the anode is reduced and thus expensive valve metal substance is saved. The cost reduction in the manufacture of this anode is however achieved at the expense of not inconsiderable disadvantages. One of the disadvantages consists in that the anodic component of the cell voltage is high because the anode operates with a high current density. This necessarily results in the substantial disadvantage of high energy requirements for the cells equipped with such anodes. The large current density and the reduced conductive cross-section of the known anode, as a result of the reduced effective surface and thus of the smaller material volume, necessarily results in a larger internal ohmic voltage drop with the consequence of further increase of the necessary electrical energy. In order to eliminate the disadvantage of the large internal ohmic voltage drop, the profile bars arranged in one plane parallel to one another, which form the effective surfaces, consist of a sleeve of titanium which is provided with a copper core. The current feed and distribution rails have a comparable construction. These are guided in a complicated manner in order to shorten substantially the current path in the small effective surface of the anode. The complicated construction of the profile bars forming the effective surface and the necessarily long current feed and distribution rails increase the expense of the known construction considerably.

In a further known coated metal anode (DE-OS No. 30 05 795) a completely different route has been taken for preventing the principal disadvantages of the above described coated metal anode, which consists in that the effective surface of this anode is constructed to be very large in such manner that the mutually spaced and parallel bars arranged in one plane to form the effective surface satisfy the relationship $6 \geqq F_A/F_P \geqq 2$, $F_A$ signifying the total outer surface of the bars and $F_P$ signifying the surface assumed by the overall arrangement of the bars. This anode construction, preferably manufactured from pure titanium, has no current feed and distributor besides the main current feed bar of copper. The current transport in the vertical direction is undertaken solely by the bars of valve metal. All in all, this anode has proved very effective in many electrolytic metal extraction methods owing to the large construction of the effective surface.

In order to adapt the titanium anodes to increasing kilowatt hour prices, i.e. to reduced internal ohmic voltage drop, the introduction of larger conductive cross-sections for the current-carrying components of this expensive metal is required. When constructing the active surface of two titanium bars arranged parallel to one another in one plane, these must be constructed with appropriately large cross-section in order to keep pace with the internal ohmic voltage drop occurring in thick massive lead anodes, which reduces again the technical and economic advantages of the valve metal anodes.

With the known current feed and distribution rails, consisting of a core of copper and a sleeve of titanium surrounding this copper core, it is attempted to achieve a "metallurgical joint" between the metal of the core and the metal of the sleeve. The reduction of the internal voltage drop, which is supposed to be achieved by constructing the core of a metal having good electrical conductivity, is only however actually achieved if the current transfer to the coated active part is ensured by a large area fault-free metallurgical joint between the material of the sleeve and the material of the core. This requirement is however achieved to a limited extent only with a very expensive manufacture. In spite of this, these current feeds for anodes have proved effective in chlor-alkali-electrolysis according to the diaphragm process. The temperature sensitivity of the metallurgical joint between copper and titanium requires however that when recoating these DIA anodes the titanium clad copper bar is separated from the active part to be coated.

The electrode set forth in the preamble of claim 1 was developed to solve these problems (DE-OS No. 32 09 138). According to this, attention was first of all directed to the construction of the current feed and of the current distributor. The main constructional idea in this electrode consists in that the current feed and the current distributor are constructed from a valve metal sleeve assembled from profile members and having a core therein of metal which is a good electrical conductor, the core being in good electrical connection with the sleeve and moreover a contact structure being embedded in this core which consists of valve metal and is connected via a plurality of weld points to the inner surface of the sleeve. Such a contact structure is three-dimensional a plurality of directions and is surrounded by the core metal from a plurality of directions. According to a preferred embodiment, the contact structure consists of one or more strips of expanded metal, wire netting, apertured sheet or the like. Each strip advantageously lies in the current feed or current distributor in the direction of current flow. By means of the described features, in the known electrode a good electrical connection between the core metal and the sleeve metal is achieved with the consequence of small voltage drops even with high current loads. The internal contact achieved between the contact structure and the core metal remains effective for a long service life even when subjected to high temperature differences. Moreover, the contact structure improves the mechanical strength of the correspondingly constructed current feeding component and thus of the electrode as a whole. The described electrode can moreover be manufactured cheaply and economically because the difficulties which occur in the previously known arrangements in respect of the metallurgical joint between the core metal and the sleeve metal or in respect of the provision of a suitable intermediate layer, for example of a substance which is liquid at the operational temperatures, are avoided. In the manufacture of the known electrode, the core metal can be simply poured into the inner space of the sleeve in the fluid state. As a result of the corresponding formation of the contact structure, the core metal flows around inside the contact structure and forms a shrink fit on this with the creation of residual stresses. As a result, the desired good contact between the core metal and the contact structure is achieved. This is in addition welded in an electrically conductive manner to the inner surface of the sleeve. Thus, everything considered, the known electrode is distinguished by a very small internal voltage drop over a long service life, by cost-favourable and economic manufacture possibilities, by high operational safety and by its relatively flat construction.

In further experiments with this known electrode, it has proved that having regard to certain constructional features it is not yet fully optimized. In some respects, the profile members which in the known electrode are used for the construction of the sleeve of the current distributor cannot readily be assembled with the desired exactitude with the consequence that the necessary tolerances for these components cannot be maintained. Furthermore, with reference to the arrangement of the sleeve of the current feed or of the current distributor, embodiments are suggested in which, for example as a result of the depth and small width of the profile member, the contact structure cannot be inserted into and welded to the inner surface of the sleeve without difficulty. Furthermore, for mounting the active parts on the sleeves of the current distributor, additional constructional steps are necessary, for example the provision of corner profile members or the like which on the one hand must be welded to the sleeve of the current distributor and on the other hand must be welded to the active part, in order to form the necessary mechanical and electrical connection between the relevant components. Finally, with the known electrode, profile members must be used for the sleeve of the current distributor and for the current feed which can be connected only by a welding process, which on the one hand in some cases is only possible manually and on the other hand necessitates distortion of the profile members as a result of the high temperature loads which thereby result.

It is therefore an object of the invention to develop the above-described electrode in such manner that not only does it have the smallest possible internal voltage drop after long service life but also permits economic manufacture in particular having reference to the profile members for the sleeve of the current distributor and the joining of the current distributor to the active parts. Moreover it should have a sturdy construction which is of particular significance for the given purpose since these electrodes are often withdrawn from the cells, for example for stripping or cleaning, and thereafter must be inserted into these again, considerable mechanical strains being exerted on the electrodes during these operations and movements. Also, the movement of the counter electrodes can lead to similar mechanical strains of the electrodes.

This object is solved with an electrode of the abovedescribed construction in that the two identically formed profile members of which the sleeve of the current distributor is assembled are each formed from a crosspiece and two limbs of unequal length bent from respective ends thereof at right angles but in opposite senses, and in that the two profile members are placed oppositely together in such manner that the short limb of the one profile member lies in the region of the free end of the long limb of the other profile member, whereby projecting flanges result, and in that the plate-like elements of the active part are connected to the current distributor via these flanges.

The electrode according to the invention is distinguished by a series of advantages.

The profile members suggested for the construction of the sleeve of the current distributor are symmetrically constructed and can be manufactured from sheets by the production of only two bends. All this leads to a rational and economic large scale series production. In addition, the selected profile members are very suitable for flat production and are furthermore stable against distortion so that sleeves for the current distributor can be manufactured which correspond to the desired narrow tolerances in the dimensions.

Even before the assembly of two profile members to form a sleeve for the current distributor, the contact structures of the above-mentioned type may be easily mounted and welded in each of the profile members since the profile members are flat and for that reason easily accessible even for automatic welding apparatus.

As a result of the selected form of the profile member, flanges necessarily result on both sides of the sleeve when they are assembled. By means of these flanges, the profile members themselves can not only be easily welded together. Moreover, the plate-like elements which form the active parts can be simply and economically secured to these flanges without additional constructions. Thereby an electrode which is flat as a whole results. Such electrodes not only make economic use of the space in the cell but also can be simply moved in and out of the cell for the cleaning or stripping process without the danger of mechanical damage. For the stripping machine, for example in the recovery of metal oxide, a flat and robust construction of the electrode is naturally of advantage also.

The flanges in the electrode according to the invention can be constructed to be so wide, according to requirements, that without mutually disadvantageous effects both the weld seams for connection of the profile members and also the weld seams for connection of the plate-like active elements can be applied on the sleeve of the current distributor. When forming the weld seam for the connection of the sleeve to the active part, this is particularly important because otherwise not only the core metal in the sleeve could suffer as a result of the temperature loading but also the weld seam between the profile members, which of course must be constantly gas and fluid tight, could lose its sealing properties.

The advantage that the weld seam necessary for mounting the active part on the current distributor does not itself influence the construction of the current distributor is of particular significance as regards the possibility of recoating the active parts. For this purpose, the weld seam between the respective active part and the sleeve of the relevant current distributor must be easily releasable and easily able to be reestablished. First of all, the possibility of coating the plate-like elements of the electrode forming the active part separately brings particularly important advantages. Thus, a low expenditure is necessary for coating of the platelike elements separately without the associated current feed. Furthermore, then only the active parts need be held in reserve by the user so that relatively little capital is tied up. Furthermore, when removing the current feed from the active parts, these are subjected to no adverse effects as is the case with combined coating of active part and current feed. Finally, it is only through the possibility of simple exchange of the active parts of the current feed and distribution construction that the use of a thinner coating on the active parts than previously usual becomes economically feasible.

An expedient development of the electrode according to the invention consists in that the two sleeve profile members are connected together in the region of the flanges by means of roll welding. Roll welding produces, in an economically favourable manner, a connection of the sleeve profile members which is both gas tight and fluid tight. As a result, the core metal is reliably protected from corrosive attack, in particular by the electrolyte.

A particularly favourable construction of the seam weld between the sleeve of the current distributor and the active part is achieved in the electrode according to the invention in that in the region of the free end of the respective flange of the current distributor a weld surface is provided to which a weld surface on the plate-like element of the active part corresponds in such manner that in the assembled construction the two weld surfaces lie in one plane and form a slot and in that a weld seam is applied on the weld surfaces thus bridging the slot. The provision of the slot between the two weld surfaces allows a particularly simple separation of the active part of the current distributor without the danger of damage of these two components because the slot forms a type of "desired breaking line". The reactivated active part can then be rewelded onto the current distributor with use of the identical weld surfaces. By the possibility of simple exchange of the active part, the advantages already mentioned in connection with the electrode according to the invention are achieved.

Where the mechanical strength permits, it is expedient for the construction of the weld connection between the active part and the current distributor to form the weld seam from a plurality of weld seam sections which are mutually spaced. This permits then a particularly simple and rapid release of the active part from the current distributor.

Specific embodiments of the described weld connection between the active part and the sleeve of the current distributor consist in that the weld surface on the flange of the sleeve of the current distributor or on the plate-like element is formed by a separately mounted material strip or in that the weld surface on the flange of the sleeve of the current distributor or on the plate-like element is formed by an integral fold. Both types of embodiment can be used with advantage. Both the mounting of additional material strips and also the fold of the sheet part of the respective component for production of mutually plane-parallel and slightly spaced weld surfaces on the active part and sleeve of the current distributor can be manufactured in a simple technical manner. Separate mounting of a material strip for production of a respective weld surface can be of advantage if the active part is exchanged relatively often and thereby the weld surface is consumed. In this case, by separation of the material strip and mounting of a new material strip, a renewed weld surface is made available. By this means, the lifetime of the electrode according to the invention or of its components can be prolonged even further.

In order to construct the effective surface of the electrode according to the invention to be as large as possible, it is of advantage in a further embodiment of the invention that the plate-like element is so arranged on the sleeve of the current distributor that with one section it at least partially covers the sleeve. In the case in which both sides of the current distributor each have a plate-like element, which plate-like elements together form the active part, it is expedient that the one element completely covers the one side of the sleeve, and the other element completely covers the other side of the sleeve. Thereby, the entire surface of the sleeve belongs to the active surface of the electrode.

According to a further embodiment of the invention, it is of particular advantage that the plate-like elements of the active part consist of corrugated expanded metal. By the use of corrugated expanded metal the electrode according to the invention provides a particularly large effective surface. The electrodes according to the invention which increase the mechanical sturdiness of the active part consisting of corrugated expanded metal offer many advantages. First of all, the free side edges of the plate-like elements can be covered by a U-shaped strip or folded. By both expedients, protection of the side edges of the active part formed of expanded metal against buckling or hooking onto other components of the cells can be achieved. The corrugated upper and lower edges of the plate-like elements can be covered by a material strip for the above-mentioned purpose.

The expendient materials for the active part of the electrode according to the invention have already been described. Accordingly, it consists of a carrying core of a valve metal such as for example titanium, zirconium, niobium or tantalum, on which a coating of an anodically effective material, for example of metals of the platinum group or of the platinum metal oxides, is applied. As a result of the easy exchangeability of the active parts in the electrodes according to the invention, as has also already been described, a particularly thin coating can be employed.

The profile members for the sleeves of the electrode according to the invention expediently have a wall thickness between 0.5 mm and a few millimeters. They consist likewise of a valve metal of the type mentioned. As sealing metal for the manufacture of the core of the current distributor used in the electrode according to the invention, metals having a melting point which lies at least 500° C. lower than the metal of the sleeve of the current feeding components are suitable. The core metal should furthermore have a substantially higher electrical conductivity than the valve metal of the sleeve, for example titanium. Having regard to these requirements, the core metal may be manufactured from zinc, aluminium, magnesium, tin, antimony, lead, calcium, copper or silver and corresponding alloys. Of course, selection of the metal for the core must take account of the special requirements of the respective metal extraction process. For the electrolytic extraction of zinc, zinc may be employed as core metal. The same applies for the extraction of copper, although here also aluminium, magnesium, or lead and corresponding alloys may be employed.

The solution according to the invention is suitable for the construction both of smaller electrode types with electrode surfaces of about 1.0 to about 1.2 $m^2$ and also for so-called jumbo electrodes having an electrode area of about 2.6 $m^2$ to about 3.2 $m^2$.

The construction and advantages of exemplary embodiments of the electrodes according tq the invention will be explained in the following with reference to the drawings, in which.

Figure 1:
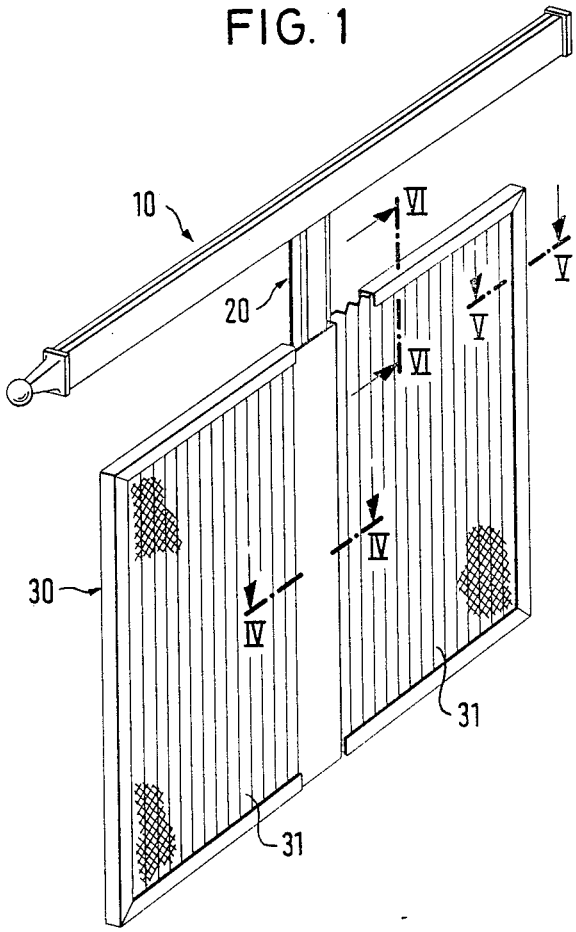
FIG. 1 shows a perspective overall view of a small electrode according to the invention.
Figure 2:
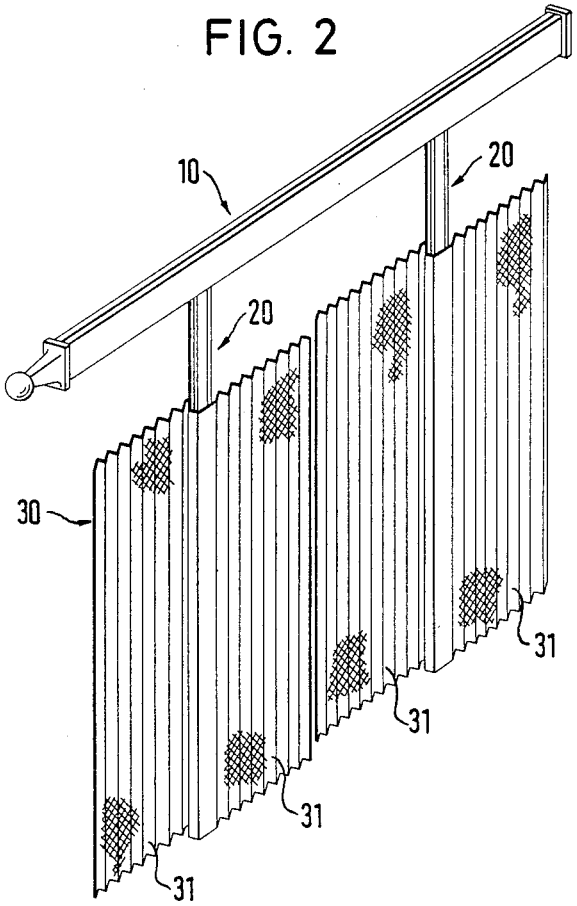
FIG. 2 shows a perspective overall view of a large electrode according to the invention.

FIGS. 1 and 2 show the principal construction of two versions of coated metal anode according to the invention. Thus, there is illustrated a current feed 10, a current distributor 20, and an active part 30 connected to the current distributor 20, i.e. the active working surface of the electrode. FIG. 1 shows in this connection the small version of an anode having an anode surface of about 1.0 to 1.2 $m^2$. Only one current distributor 20 is provided per anode, the distributor carrying two plate-like elements 31 as active part 30. FIG. 2 in contrast shows a so-called jumbo anode having an anode surface of 2.6 to 3.2 $m_2$. With this electrode, in each case two current distributors 20 extend downwardly from the current feed 10. On each current distributor a plate-like element 31 is arranged on each side. The side edges of the two inner plate-formed elements 31 can be mutually spaced and can be connected together by means of bridging elements. The two inner plate-like elements 31 can however also be constructed by one integral element.

Figure 4:
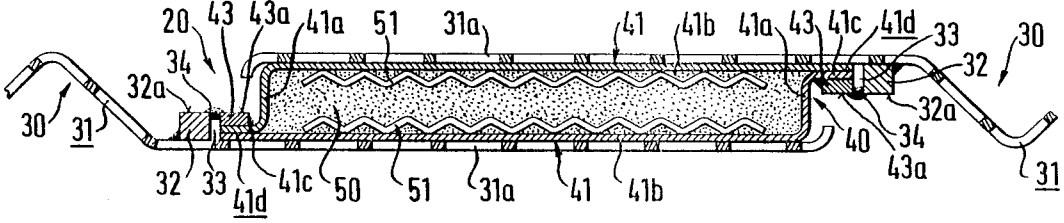
FIG. 4 shows a section through the arrangement according to FIG. 3 along the section line IV—IV.

The sectional view of FIG. 4 shows particularly clearly the construction of the current distributor 20 and the connection of the active part 30 or the plate-like elements 31 to the current distributor 20.

Thus, the current distributor 20 is constructed of a sleeve designated with 40 as a whole consisting of valve metal and a core 50 arranged therein and consisting of metal which is a good electrical conductor and being in electrical connection with the sleeve 40, and contact structures 51 of the already-described type being embedded therein which consist also of valve metal and are connected by means of a plurality of weld points to the inner surface of the sleeve 40.

The sleeve consists of two identically constructed profile members 41. The form of each profile member 41 is combined from a crosspiece **41*a* from whose ends at right angles and in opposite directions limbs 41*b* and 41*c* extend, the limb 41*b* being longer than the limb 41*c*. For the formation of the sleeve 40, the profile members 41 are assembled together oppositely, i.e. rotated by 180° in the longitudinal direction, so that the short limb 41*c* of the one profile member 41 lies in the region of the free end of the long limb 41*b* of the other profile member 41. As a result, the sleeve 40 provides on its narrow sides mutually offset projecting flanges 41*d*. In the region of the inner ends of the flanges 41*d*, the two profile members 41** are connected together by roll welding in such manner as to be gas and liquid tight.

For connection of the thus constructed current distributor 20 to the current feed 10, the upper front surface of the sleeve 40 is covered with a titanium plate 42 which forms the connection element to the current feed 10. The current feed 10 may consist exclusively of a rail preferably of copper, or may be a composite construction similar to the current distributor, a copper rail guided therein then forming the current transporting component.

The exact connection construction can be arbitrarily chosen in the present case.

The active part 30 consists of two plate-like elements 31 of which the one is connected to the one flange **41*d* of the sleeve 40 of the current distributor 20 and the other on the oppositely lying flange 41*d* of the sleeve 40 of the current distributor 20 in a manner to be described in more detail in the following. The respective connection is formed by a weld construction. For this purpose, on the side of the respective flange 41*d* facing away from the plate-like element 30, a strip 43, running parallel to the axis of the sleeve 40, likewise consisting of a valve metal, is welded. The plate-like element 31 carries on its side facing the flange 41*d* a strip 32, running parallel to the axis of the sleeve 40, which expediently consists of the same material as the plate-like element 31 itself and can be welded thereto. Plate-like element 31 and sleeve 40 are then so arranged that both strips 43 or 32 run mutually parallel to form a slot 33 and their free upper surfaces 43*a* or 32*a* form weld surfaces lying in one plate. Along these weld surfaces 32*a*, 43*a*, a weld seam 34 is applied thus bridging the slot 33, the weld seam 34 being expediently formed by weld seam sections which are mutually spaced. Separation of this weld seam 34 is possible by means of a simple separation tool without difficulty, since, as a result of the slot 43 in which the separation tool can possibly be inserted to some extent, impermissible damage of the components, that is of the sleeve 40 and the corresponding plate-like element 31**, is prevented.

Figure 3:
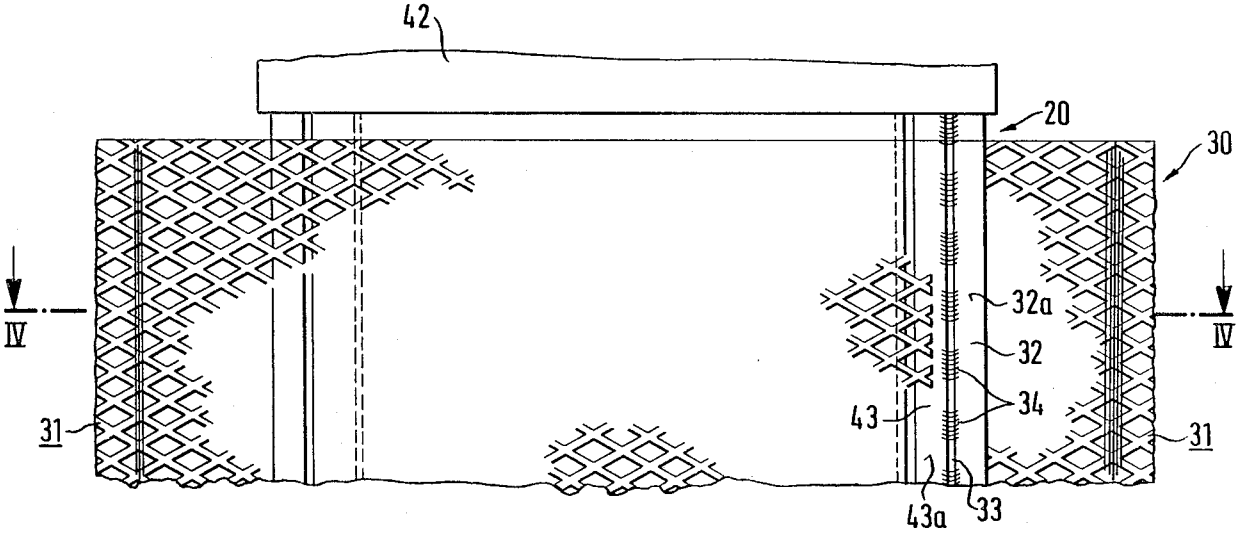
FIG. 3 shows an enlarged view of the current distributor and the active part of the electrode according to the invention.

As best seen from FIG. 3, the plate-like elements 31 completely cover the respective sides of the sleeve 40 with their respective sections 31*a* so that these are substantially surrounded by the plate-like elements 31 which form the active part, with the consequence that the surfaces of the current distributor 20 are available as active surface of the electrode.

As appears from FIGS. 3 and 4, the plate-like elements 31 consist of corrugated expanded metal whose corrugations extend parallel to the axis of the current distributor 20. Only the overlapping sections 31*a* of the plate-like element 31 are constructed to be flat.

Figure 5:
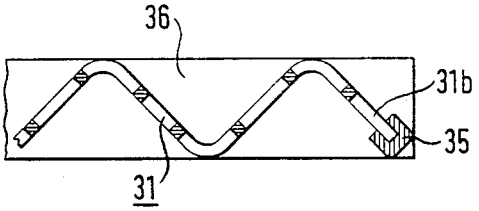

In constructing the active part 30 using expanded metal it is recommendable, as shown in FIG. 5, to protect the free side edges 31*b* of the plate-like elements which run parallel to the axis of the current distributor 20 against buckling or hooking onto other constructional elements. For this purpose, on these free side edges 31*b* respective U-shaped edge strips 35 are provided which may consist of the same material as the plate-like elements 31 themselves and are connected to these in a form or force locking manner.

Figure 6:
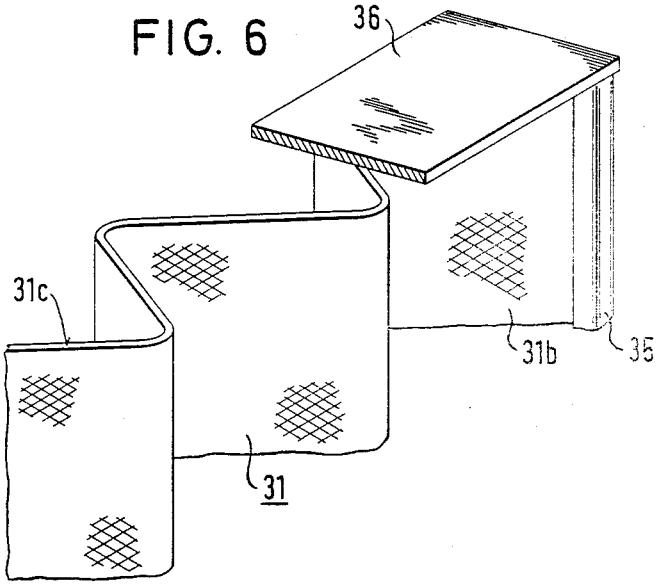
FIGS. 5 and 6 show views of the protection of the free edges of the active part of the electrode according to the invention.

As illustrated in FIG. 6, also the upper and lower edges 31*c* of the plate-like elements 31 are expediently protected, thus by means of a respective material strip 36 which covers the wave-shaped edges 31*c* and extends at right angles to the main plane of the plate-like element.

We claim:

1. Electrode, in particular anode of coated valve metal for electrolytic extraction of metals or metal oxides, comprising:

at least one current distributor assembled from two profile members and a core which is arranged between the profile members, and is of a metal which is a good electrical conductor and is in electrical connection with the profile members; and an active part which is mechanically and electrically connected to the current distributor, wherein each said profile member comprises a cross-piece and two limbs of unequal length extending from respective ends thereof at right angles in opposite directions, the two profile members are assembled in such manner that the shorter limb of the one member lies in the region of the free end of the longer limb of the other profile member, whereby projecting flanges result, and the active part is connected to the current distributor via said flanges.

2. Electrode according to claim 1 wherein the two profile members are connected together in the region of the flanges by roll welding.

3. Electrode according to claim 1 wherein in the region of the free end of at least one projecting flange of the current distributor a weld surface is provided to which a weld surface on the active part corresponds in such manner that the two weld surfaces are coplanar and define a slot therebetween, a weld seam being applied on the weld surfaces which bridges the slot.

4. Electrode according to claim 3 wherein said weld seam comprises a plurality of weld seam sections which are mutually spaced.

5. Electrode according to claim 3 wherein at least one said weld surface comprises a separately applied material strip.

6. Electrode according to claim 3 wherein at least one said weld surface is formed by an integral fold.

7. Electrode according to claim 1 wherein said active part is so arranged to at least partially cover the current distributor.

8. Electrode according to claim 7 wherein on each side of the current distributor a respective active part is arranged and the one part covers one side of the distributor and the other part covers the other side of the distributor.

9. Electrode according to claim 1 wherein said active part consists of corrugated expanded metal.

10. Electrode according to claim 1 wherein at least one edge of the active part is covered by a U-shaped strip.

11. Electrode according to claim 1 wherein at least one edge of the active part is folded back.

12. Electrode according to claim 1 wherein at least one edge of the active part is covered by a material strip.

* * * * *